United States Patent [19]

del Rio

[11] 4,269,449

[45] May 26, 1981

[54] METHOD FOR PREPARING AN OIL SHALE DEPOSIT FOR IN SITU RETORTING

[75] Inventor: Salvador M. del Rio, Golden, Colo.

[73] Assignee: Mineral Industries Engineers, Inc., Golden, Colo.

[21] Appl. No.: 950,801

[22] Filed: Oct. 12, 1978

[51] Int. Cl.[3] ..... E21C 41/10

[52] U.S. Cl. ..... 299/2; 166/259

[58] Field of Search ..... 299/2

[56] References Cited

U.S. PATENT DOCUMENTS

| | | | |
|---|---|---|---|
| 4,043,595 | 8/1977 | French | 299/2 |
| 4,043,596 | 8/1977 | Ridley | 299/2 |
| 4,109,718 | 8/1978 | Burton | 299/2 X |
| 4,109,964 | 8/1978 | Ridley | 299/2 |
| 4,118,070 | 10/1978 | French et al. | 299/2 |
| 4,118,071 | 10/1978 | Hutchins | 299/2 |
| 4,131,416 | 12/1978 | Watson et al. | 299/2 |
| 4,133,380 | 1/1979 | Burton et al. | 299/2 X |
| 4,140,343 | 2/1979 | Mills | 299/2 |
| 4,143,917 | 3/1979 | Sweany | 299/2 |
| 4,153,110 | 5/1979 | Ridley | 299/2 |

*Primary Examiner*—Ernest R. Purser

*Attorney, Agent, or Firm*—Wm. Griffith Edwards

[57] ABSTRACT

A method for preparing a shale oil deposit for in situ retorting includes providing a drilling and process control level above the deposit with a substantial thickness of personnel isolating and protecting formation between the deposit and the level, providing a collecting and pumping level below the deposit with a substantial thickness of personel isolating and protecting formation between that level and the deposit, and excavation providing voids affording fragmentation of shale in the retorting zones reached from the collecting level. The shale excavated to provide the voids is transported through access risers to the collecting level; closures serving as sumps and protective gratings for the sumps are installed in the upper ends of the risers. Introduction of combustion gases from the control level is accomplished through drill holes provided for this purpose, some of the drill holes also being provided with control or detecting devices. As the combustion and heating of the fragmented shale proceeds, the resulting liquid flows downwardly through the retorts and into the collecting zone. There separating and pumping equipment is provided for the purpose of delivering the separated fluids to the surface. An arrangement of continuous retorts is operated from the control and collecting levels; adjacent retorts are protected by bulkhead doors for emergency isolation of the working areas. The voids in the depleted fragmented shale in the retort are filled with a water slurry of ground depleted shale.

25 Claims, 14 Drawing Figures

METHOD FOR PREPARING AN OIL SHALE DEPOSIT FOR IN SITU RETORTING

This invention relates to the preparation of oil shale deposits for in situ retorting and particularly to improved methods for facilitating the preparation of the deposit for efficient retorting and for affording increased safety for the working personnel during both the preparation and retorting of the oil shale.

BACKGROUND OF THE INVENTION

In recent years much time and effort have been spent on the research and development of methods for recovering fuel from oil shale. Oil shale contains kerogen, a complex hydrocarbon substance intercalated in thin layers throughout the shale. Through the application of heat, kerogen can be destructively distilled to yield a liquid, commonly called shale oil but, herein referred to alternatively by a new term, "keronol"; the distillation also yields some gaseous products. In order to assure efficient heating, the oil shale is broken into fragments sufficiently small to permit the heat to saturate the shale and to allow the produced shale oil or keronol and gases to escape from the mass of fragments. The conventional mining of oil shale, followed by crushing and retorting above ground is effective to produce shale oil and gas, however, this procedure leaves large quantities of spent shale or barren rock at the surface, the disposition of which involves an environmental problem. For the purpose of avoiding the large scale accumulation of spent shale, various methods have been proposed and tested for the retorting of the oil shale underground or in situ so that the quantity of oil shale which must be mined out is minimized. Calculations and experience indicate that the total aggregate volume of the shale which must be mined out of an in situ retorting zone is of the order of fifteen to twenty percent of the entire mass before fragmenting. Various methods have been proposed for providing voids in the oil shale deposit and fragmenting or "rubbleizing" the shale to fill the voids with the fragmented shale and provide the permeability of the mass of shale required for effective retorting. The fragmented oil shale is ignited at, or near the top of the prepared retort, and combustion is maintained by injecting oxygenated gases into the retort. Retorting can also be done without combustion by circulating hot, inert gases through the rubble. Heat generated by the combustion decomposes the kerogen in the shale to produce liquid and gaseous products and these flow downwardly through the fragmented mass and are removed.

Much of the attention of those involved in the developing oil shale industry is now directed toward the retorting of the oil shale underground. Underground retorting is complicated and an expensive operation and in order that such operations be commercially feasible it is necessary that the retorting of very large deposits be carefully planned; such retorting may, for example, require a multiplicity of separate retort zones, each of which may be capable of yielding a million or more barrels of shale oil. Such deposits may extend for many square miles and may range up to several hundred feet in depth or thickness. Tracts of land containing such deposits may, for example, comprise a multiplicity of separate retorts, in each of which the retorting operation may be carried or independently of the others and the retorts may be operated in a planned sequence to provide a continuous supply of the keronol product.

The preparation and operation of such planned retorting of an oil shale deposit requires many engineers and technicians and a large number of workmen, and it is essential, for efficient production of shale oil, that the working areas be arranged for effective and efficient preparation and operation of the retorts and it is desirable that reliable and easily installed and monitored instruments be provided for controlling the retorting operation. It is also essential that the preparation and operation of the retorts be effected with maximum safety for the personnel.

The present invention is directed particularly toward providing a highly effective and efficient procedure for preparing the oil shale deposit for underground retorting and for providing safe working zones and conditions for all personnel.

It is an object of this invention to provide an improved method for preparing an underground oil shale deposit for in situ retorting.

It is another object of this invention to provide an improved method for preparing an underground oil shale depsoit for in situ retorting and for assuring safe operating conditions both during the preparation of the retort and during its operation.

It is another object of this invention to provide a method for preparing an underground oil shale deposit for in situ retorting including an improved method for providing and installing devices for effecting the monitoring and control of the retorting operation.

It is a further object of this invention to provide an improved method for preparing an underground oil shale deposit for in situ retorting wherein a multiplicity of contiguous retorts are prepared and including an improved arrangement for assuring the effective and safe operation of the contiguous retorts.

It is a further object of this invention to provide a process for utilizing heat energy remaining in a depleted retort after completion of the retorting operation.

It is a further object of this invention to provide a process for utilizing the heat energy in a depleted retort for the recovery of additional product.

It is a still further object of this invention to provide a method for utilizing the spent shale from surface retorting operations for filling the voids in the fragmented shale in depleted retorts.

Briefly, in carrying out the objects of this invention in one embodiment thereof, an oil shale deposit is prepared for retorting by excavating a working and fluid collecting zone in the formation below the deposit and excavating a predetermined volume of shale from the retort zone to form voids therein in a preselected configuration and sufficient in volume to contain the increased volume of the shale after fragmentation in the retort, preparing a drilling and process control level above the retort and separated from the roof of the retort zone by a substantial depth of overburden and drilling holes into the shale between the voids to form a pattern of holes for receiving explosive charges and setting off the charges to fragment the shale and fill the voids with the fragmented shale. Before fragmenting the shale, certain of the drill holes are cased above the retort zone and the remaining holes are plugged. The fragmented shale is then ignited and selected ones of the cased holes are used for facilitating the monitoring and control of the retorting of the fragmented shale and the fluid products resulting from retorting are directed downwardly into the collecting zone. The preparation of the drilling and process control level and of the collecting and pumping zone provides safe working areas isolated from the retorting zone and enabling the workers to monitor and control the retorting operation in safe locations.

The features of novelty which characterize this invention are pointed out with particularity in the claims annexed to and forming a part of this specification. The invention itself, however, together with further objects and advantages thereof will best be understood by reference to the following description taken in connection with the accompanying drawings in which:

Figure 1:
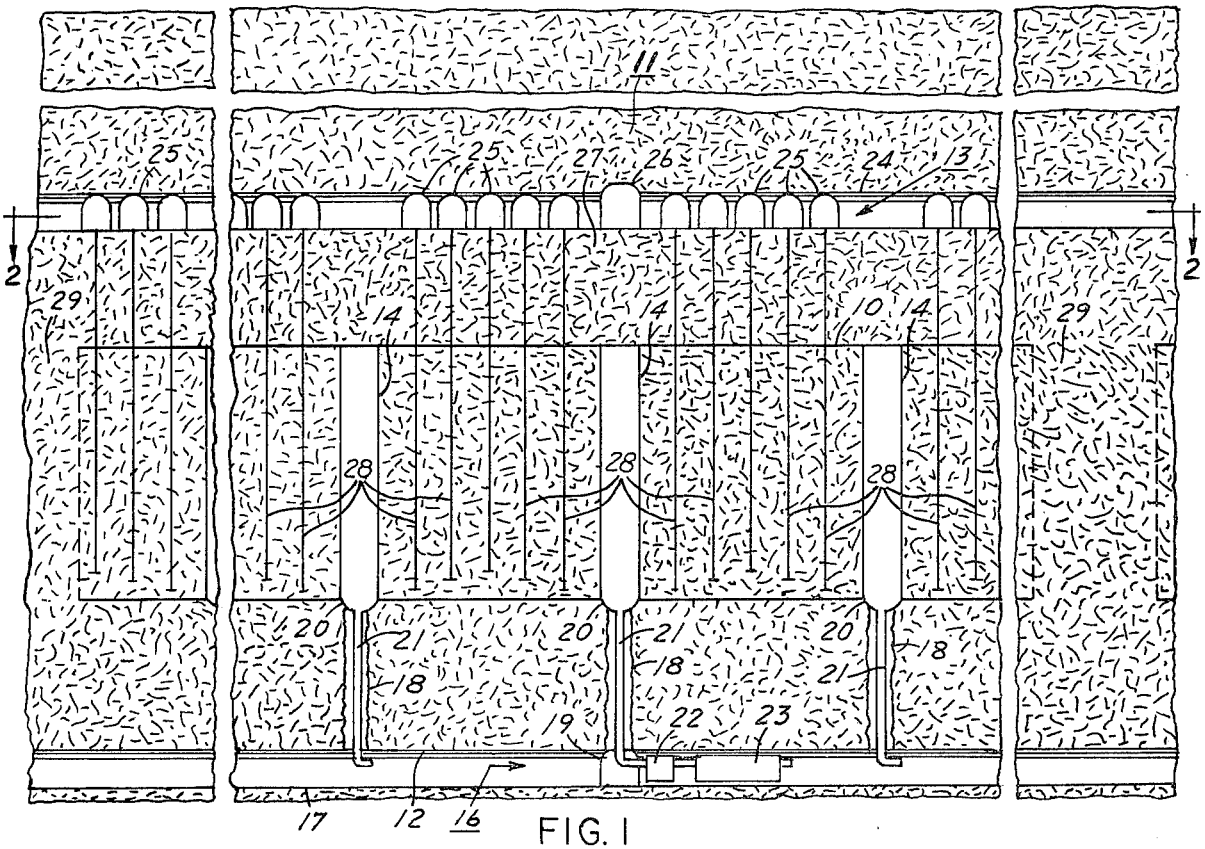
FIG. 1 is a vertical sectional view of a formation including an oil shale deposit illustrating somewhat diagrammatically, steps in the preparation of an in situ retort.
Figure 2:
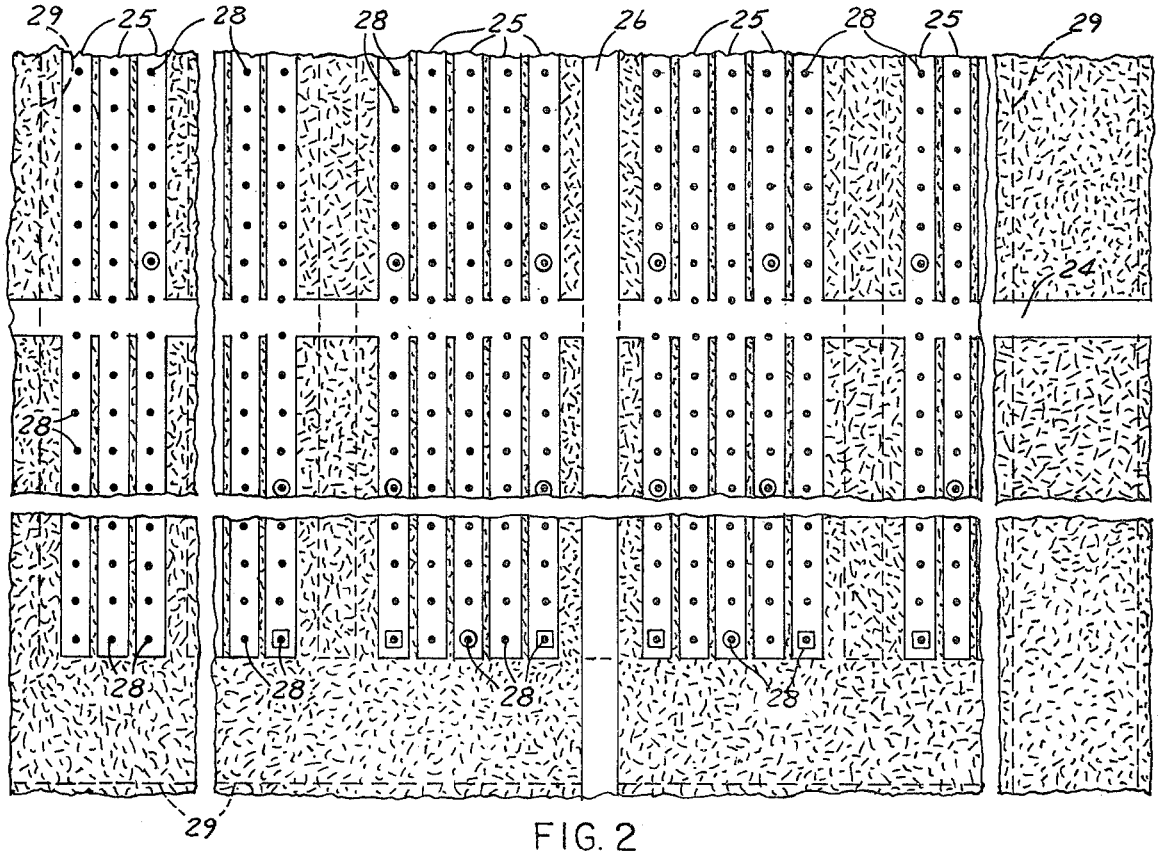
FIG. 2 is a horizontal sectional plan view along the line 2—2 of the formation of FIG. 1.
Figure 2A:
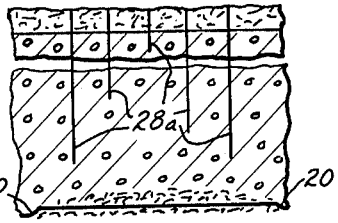
Figure 3:
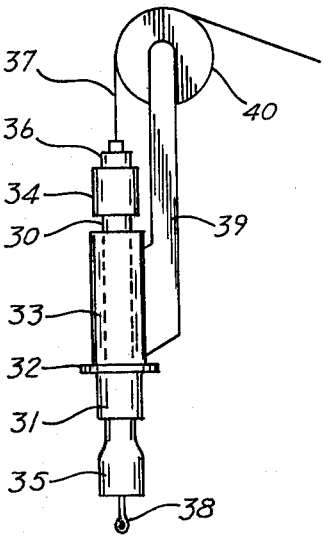
Figure 4:
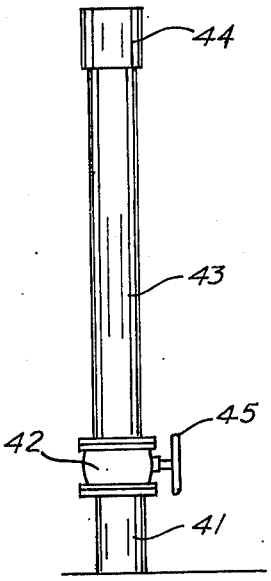
Figure 5:
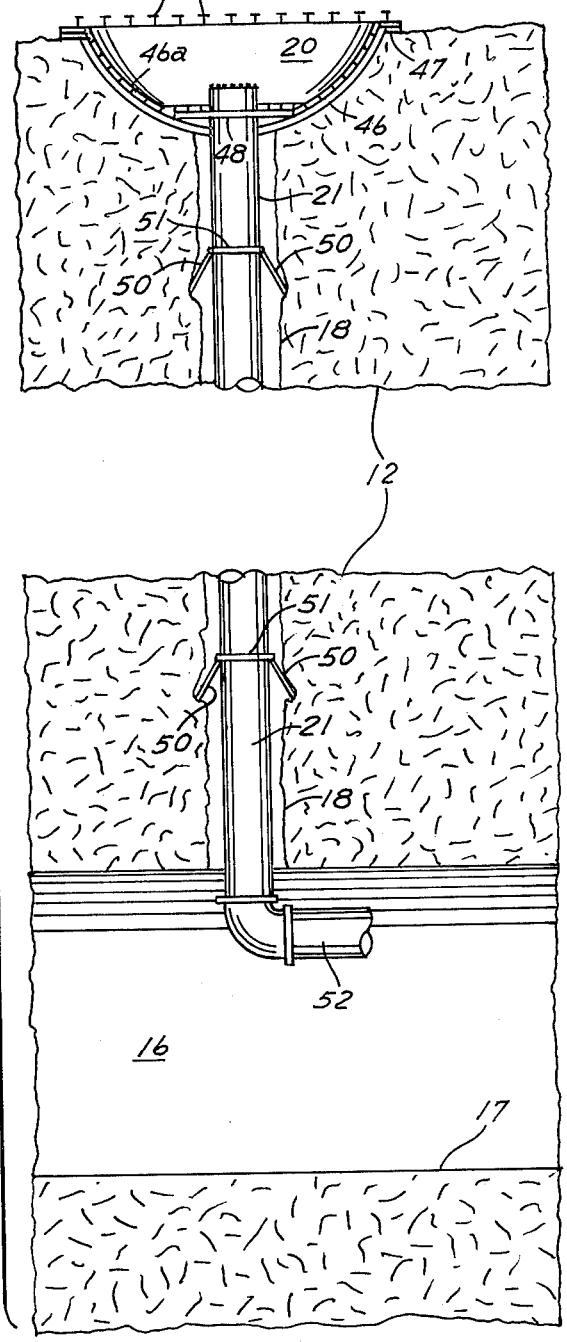
Figure 6:
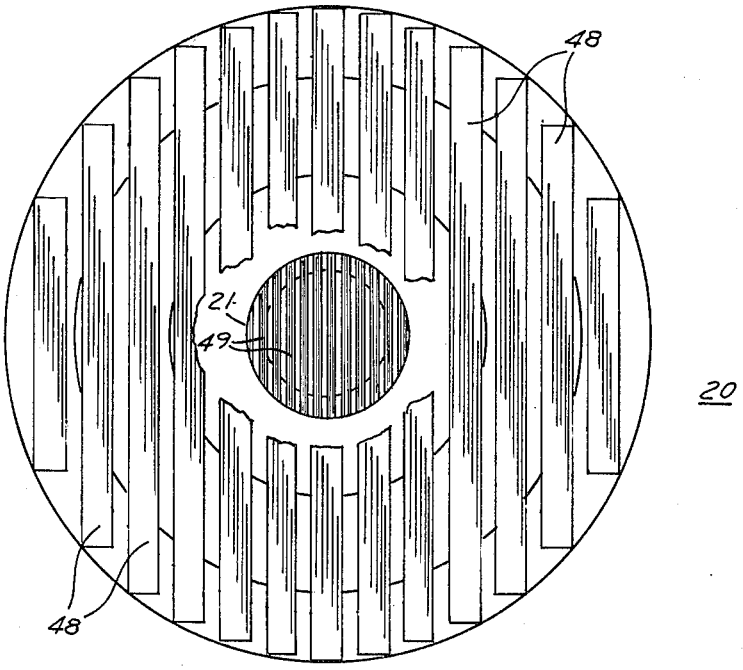
Figure 7:
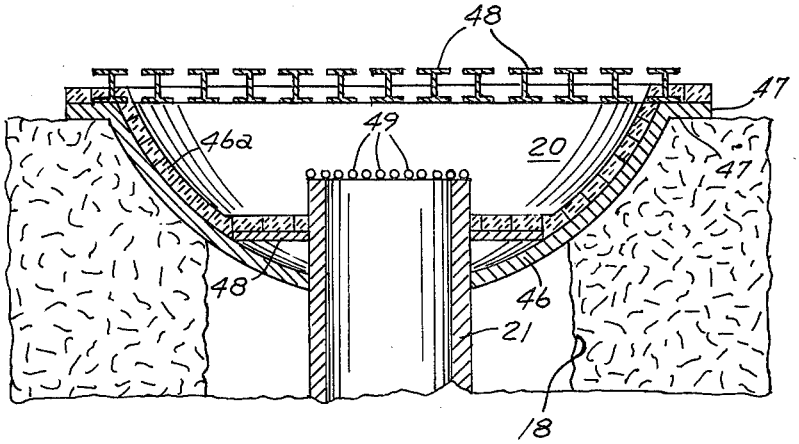
Figure 8:
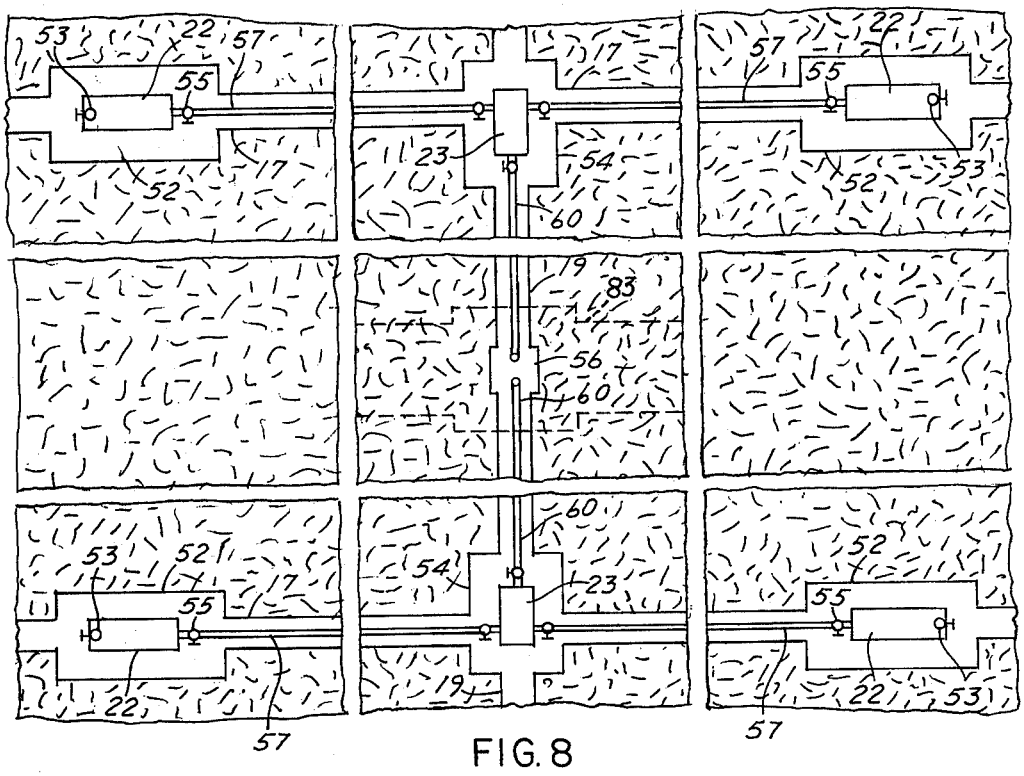
Figure 9:
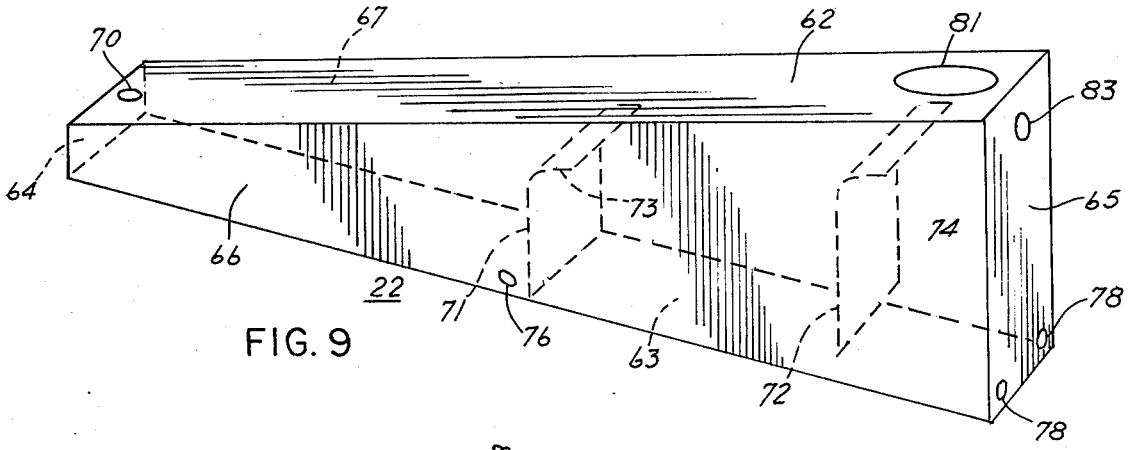
Figure 10:
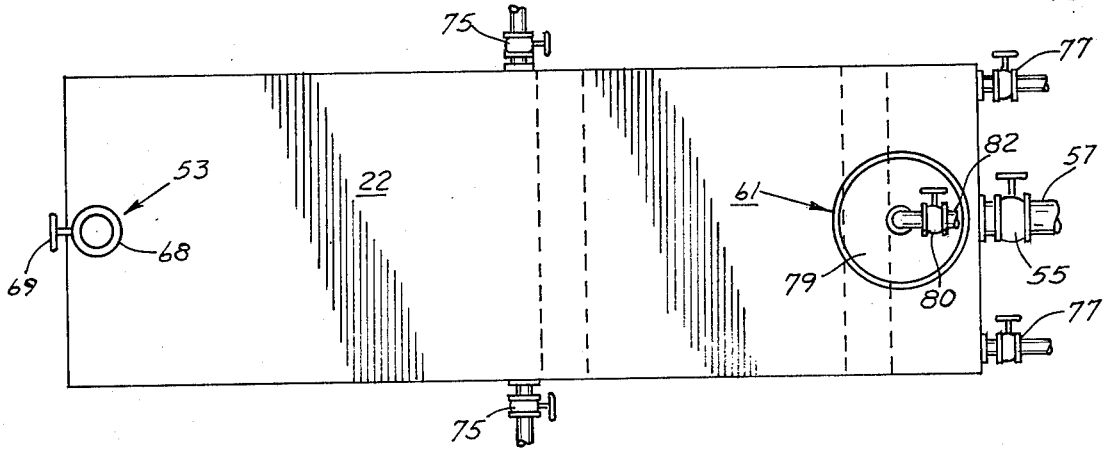
Figure 11:
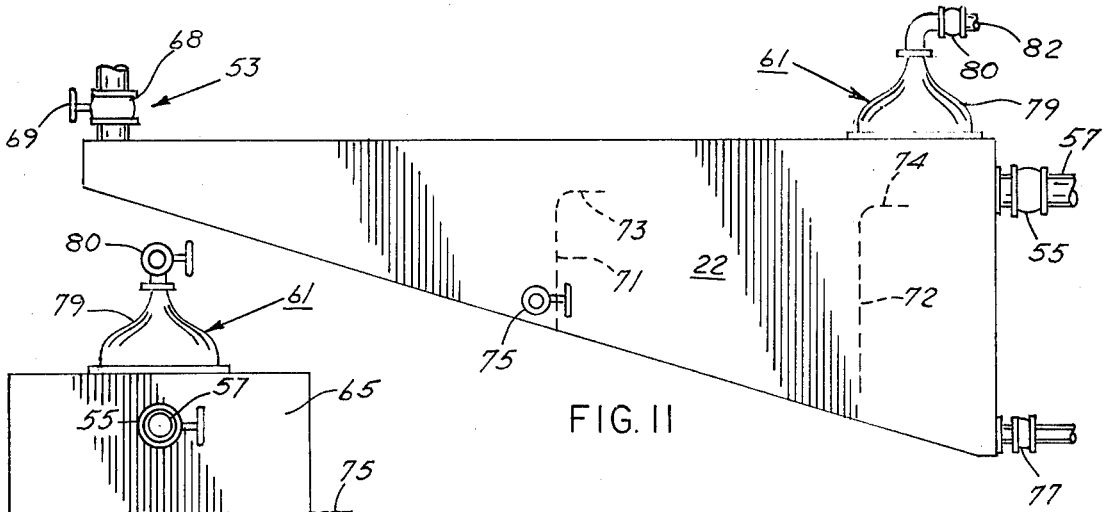
Figure 12:
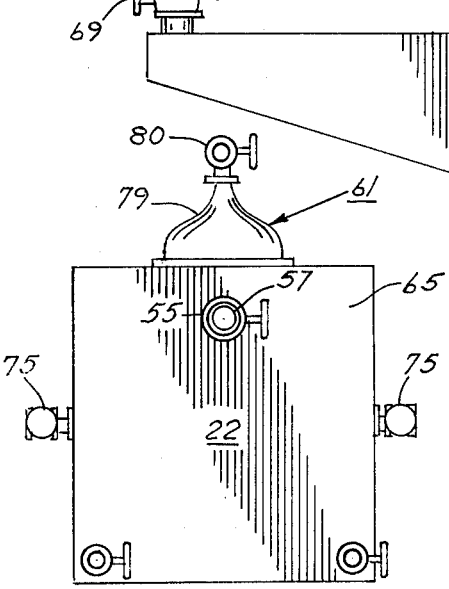

FIG. 2*a* is a diagrammatic vertical sectional view of a portion of the deposit after fragmentation and showing cased holes extending into the deposit;

FIG. 3 is a side elevation view of a device useful in connection with the operation of the retort;

FIG. 4 is a side elevation view of a casing and valve used with the device of FIG. 3;

FIG. 5 is an enlarged sectional view of the sump and drain pipe installation of FIG. 1;

FIG. 6 is an enlarged sectional elevation view of a sump used in the retort shown in FIG. 5;

FIG. 7 is a plan view of the sump of FIG. 5;

FIG. 8 is a somewhat diagrammatic sectional plan view of a subterranean collection and pumping level for shale oil produced in the retort of FIG. 1;

FIG. 9 is an isometric view of a separator used in the pumping level of FIG. 8;

FIG. 10 is a top plan view of the separator of FIG. 9;

FIG. 11 is a front elevation view of the separator of FIG. 9;

FIG. 12 is an elevation view of the outlet end of the separator; and

Figure 13:
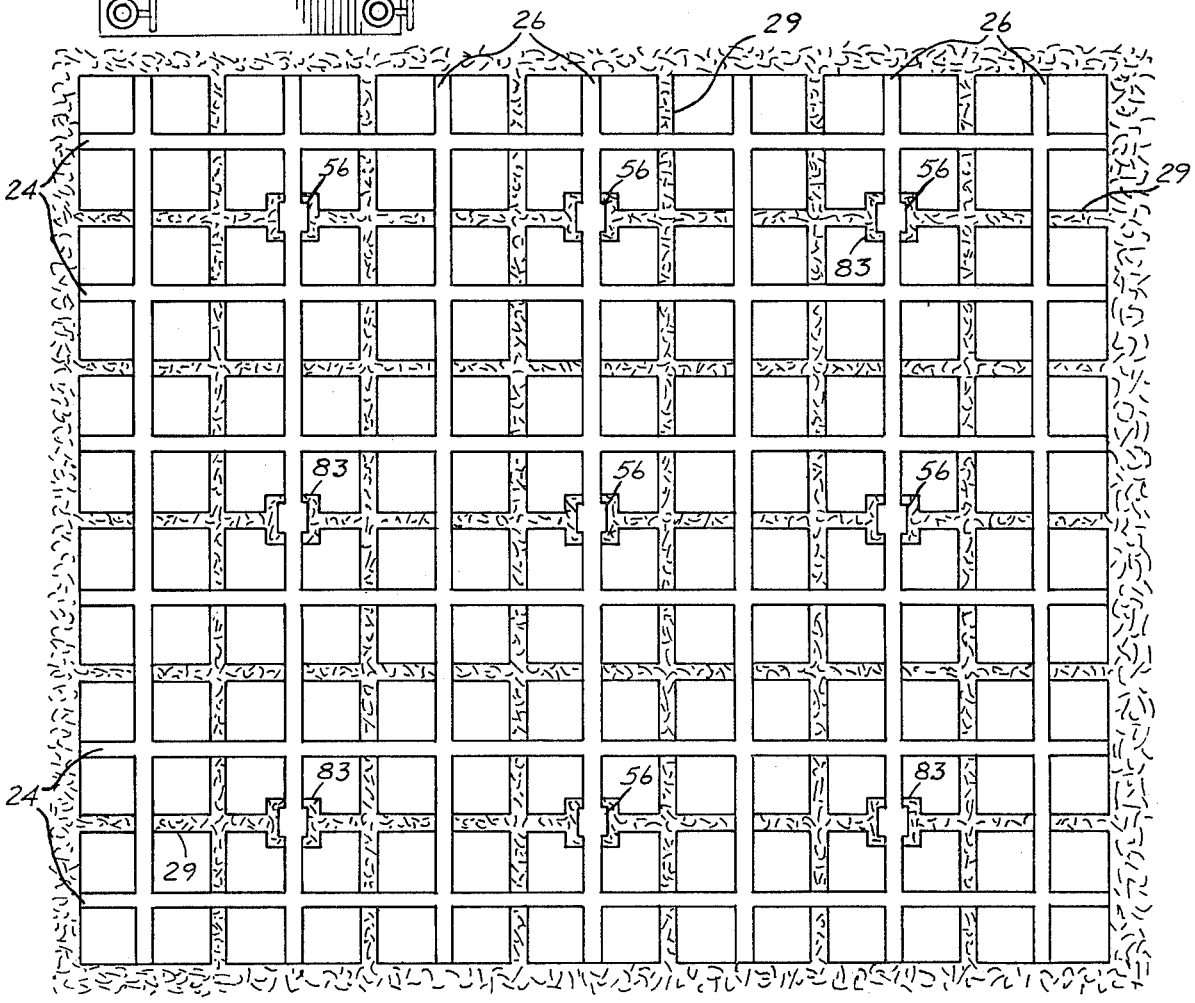

FIG. 13 is a somewhat diagrammatic sectional plan view of a tract layout for a multiplicity of retorts such as that of FIGS. 1 and 2.

The present invention provides a method for preparing an oil shale deposit for in situ retorting and which provides an arrangement for the effective and efficient starting, control and monitoring of the retorting operation, and which further provides a high degree of safety for the personnel within the operating of non-process areas of the system during the fragmentation of the deposit, as well as during the retorting operation. This invention may be employed effectively with various methods for shattering or rubbleizing the oil shale to produce the fragmentation required for operation of the retort. The invention is described below in connection with a fragmentation method which utilizes slot-like voids having parallel faces and which provide the void capacity essential to afford the required filling of the retort with the resulting fragmented oil shale. Because a portion of the shale is removed and not retorted underground, this process of retorting the remaining shale after it has been dislodged by fragmentation may be designated as a quasiin-situ method.

Referring now to the drawings, the cross section illustrated in FIG. 1 comprises the body of shale 10 which is to be retorted and which lies between an overburden 11 and the base 12 of the body 10. The term "overburden" as used herein has reference to all of the formation above the retorting zone. It will be understood that the retort or body 10 is shale sufficiently rich in kerogen for the purposes of retorting; the overburden 11 and the base 12 may also contain oil shale but of such low grade that retorting is not warranted. Within the broken away portion of FIG. 1, there is illustrated a working and control level 13, which includes crossed passageways described below, and lies within the "overburden" and is spaced a substantial distance from the top of the body of shale 10 which is referred to below the retort. This dual working and control level 13 comprises two main entries described below and which cross each other at right angles over the center of the retort and continue on to serve corresponding functions above other contiguous retorts. The body of shale 10 has been excavated to provide a multiplicity of voids, three of which are indicated by the numeral 14, and each of which is a generally slot-shaped configuration having parallel facing walls and extending from the top of the retort downwardly to the floor and, in length, from wall to wall of the retort. The retort is defined by continuous peripheral vertical walls, or pillars, the thickness of which separates it effectively from adjacent retorts; the horizontal cross section of the retort is rectangular. A dual collecting and pumping level, indicated generally by the numeral 16, is located a substantial distance below the floor of the retort proper. The level 16 contains two main entries, a passage 17 and a passage 19, which cross each other at right angles under the center of the retort, in the same vertical planes as the two main entries in the drilling and process control level 13 above the retort. These two passages continue on under the centers of other adjacent retorts to serve also as their collecting and pumping levels. Thus the two working levels 13 and 16 provide access to a number of other shafts and retort areas and, being equipped with fire and explosion-proof bulkhead doors at strategic locations within these passages, add to the safety of the personnel working within them.

In order to excavate the voids 14 within the retort for accommodation of the fragmented shale, raises 18 are driven from the collecting and pumping level 16 up into the floor of the retort. The material excavated from the slot-shaped voids 14 is chuted down the raises 18 to the level 16 for conveyance to the nearest shaft and hoisting to the surface for retorting is above-ground installations. After the excavation of the raises and voids has been completed, the raises 18 are closed at their upper ends by sump bowls 20 or other suitable closures which afford ready removal of the fluids downwardly through pipes or conduits. Thus, in FIG. 1, the central sump 20 has been illustrated as positioned to deliver fluids through a conduit or pipe 21 to a fluids and solids separator 22 from which the liquids (shale oil and water) are delivered to a pump 23 which pumps them up the shaft to a storage tank or to a refinery. Gaseous fluids, separated from the liquid and solids, are delivered to a compressor (not shown) for pumping up the shaft to the surface for use as fuel, and the sludge and other solid materials are removed from the separator 22 periodically as they accumulate. The other sumps 20 may be connected by pipes 21 to the same pump 22 or to other pumps as required by the characteristics of the system and of the fluids.

As has been stated, the collecting and pumping level 16 is located well below the bottom of the retort so that it is separated by a substantial still or horizontal pillar of rock and provides a safe working zone for personnel during the operation of the retort.

The drilling and process control zone or level 13 is reached from the surface through suitable shafts or other means of entry, such as adits from an erosion cut in the formation or from a cliff face. The level 13 includes two cross passages 24 and 26 at right angles to one another, and as shown in FIG. 2, a multiplicity of parallel drilling galleries 25 are excavated from the passage 24 and normal thereto. The cross-entry 26 extends centrally of the retort directly over the central void 14, above a pillar 27, which is a part of the overburden 11 below the level 13. The two main entries, 24 and 26, extend into the formation at both respective ends and provide passages for communication with adjacent retort complexes. The multiplicity of gallaries 25 are driven from main entry 24 to reach from wall to wall of the retort, and are parallel to the voids 14; these are the drilling galleries along which rows of blasting holes 28 are drilled as indicated in FIGS. 1 and 2. The wall of the retort which extends around the four sides is indicated by the numeral 29. The drill holes 28 in the illustrated embodiment are shown as drilled in groups of five rows between respective pairs of voids 14, the central row terminating at a bottom level higher than the other rows so that a sloping configuration results at the bottom of the retort as shown in FIG. 1. After the drill holes 28 have been completed as indicated, charges are set in them and the portions of the holes 28 within the overburden 11 are selectively either plugged or cased and valved. The cased and valved holes are selected to provide various required functions in the planned retorting process, as will be indicated in further detail below. The charges are then set off and the shale within the deposit is shattered or rubbleized to provide fragmented shale substantially filling the retort. In firing the five rows of holes in each set, the charges in the outer rows are set off first simultaneously against those of the adjoining sets to aid the fragmentation through impact, then those in the next set of holes and finally the charges in the center holes. This provides a progressive fragmentation of the shale, both from the blast and from impact, and facilititates the filling of the retort with the shattered shale; as mentioned before, the selected depths of each set of five holes results in the formation of drainage slopes at the bottom of each set. The times between setting off the charges are measured in microseconds.

For thick shale formations it may be necessary to provide additional drilling levels within the shale and such levels are excavated at the time of excavation of the voids and lower tunnels, raises, and stopes. These additional drilling levels make possible the drilling of the lower portions of the deposit and the rooms or galleries provided for such drilling are, of course, destroyed upon the fragmentation of the shale by the explosion of the charges.

Most of the drill holes passing through the overburden above the deposit are plugged. The selected ones which are cased are located in accordance with the plan for retorting, including the initation of the heating or burning of the material in the retort and the supplying of oxygen bearing gases to the retort together with the various instruments and other facilities required. The location of these cased holes is determined by the plan, and, by way of example, one such plan is indicated generally in FIG. 2 by square and round symbols about the selected holes. There are more cased holes in the first row shown at the bottom of the figure because these are used to initiate the retorting process. Those shown with a surrounding square symbol are the ignition holes through which a certain quantity of combustible material, such as gasoline, can be lowered atop the shale rubble in the retort. Hotspark coils are then lowered atop the rubble while air is injected into the retort through the other cased holes indicated by circles in the first row. Ignition of the gasoline and shale is set off simultaneously in those holes while instruments are lowered in the second row of cased holes, indicated by circular symbols, in order to monitor the progress of the process. Exhaust gases may be removed through selected ends of the cased holes. As the burning front advances, the instruments are moved to other rows of cased holes, and the vacated ones used for air injection. All of the cased holes are interchangeable in their use for various selected functions including ignition, air injection, gas extraction, hot gas circulation, sample taking and instrumentation.

By way of example, FIG. *2a* illustrates diagrammatically a section of the fragmentated deposit in which a plurality of cased holes **28*a*** are extended to selected depths in the fragmented formation, the depth being selected for the particular function to be performed. The sloping floor left at the bottom of the retort is also shown in this view.

If desired, ignition of the shale rubble can be conducted in a number of places within the retort, depending upon the rate of shale oil or "keronol" yield desired, the thermal requirements of individual retorts, their areal extent, for example, Also, some selected holes are drilled to extend through the rubble and may be cased down through the rubble to near the bottom of the retort and used for air injection or gas exhaust or both in order to induce the burning front to pervade the entire vertical extent of the retort and not remain within the upper layers of the shale rubble. The maximum temperature of the retort is also monitored so that it does not reach the melting point of the casing metal.

In order to lower instruments, sensing devices, or the like into the holes, a sheave and packing gland fitting as illustrated in FIG. 3 may be employed. This fitting comprises a short section of pipe 30 constituting the body and having a nipple or coupling 31 screwed to its lower end and a thick washer 32 secured to its upper end, a sleeve 33 is slipped over the section 30 and rests on the washer 32 and is free to rotate; the sleeve is retained on the body 30 by a coupling 34. A swage nipple or bottle nipple 35 is threaded into the lower end of the coupling 31. A packing gland 36 is screwed into the upper end of the coupling 34 and a steel wire 37 passes through the gland for movement up and down through the fitting and into the pipe below. A safety hook 38 is provided at the lower end of the wire for lowering and raising instruments into and out of the hole. A bracket 39 is welded to the sleeve 33 and extends upwardly generally parallel to the body and carries a sheave 40 over which the wire passes to and from a reel (not shown).

FIG. 4 illustrates the top end of a casing 41 of one of the holes 28 which extends upwardly from the floor 11 of the drilling zone in one of the galleries 25. The casing 41 has a gate valve 42 coupled thereto and connected to the bottom end of a section of pipe 43 which has a coupling 44 at its top. When the device of FIG. 3 is to be used, the swage nipple 35 is screwed into the coupling 44 to position the apparatus of FIG. 3 on the pipe 43. The desired instrument or detecting device having been secured to the hook 38 and the parts assembled, the instrument may be lowered into the well, the valve 42 being operated by its handle, indicated at 45, to open the gate valve and admit the instrument to the casing 41 below. When the instrument or detecting device has been lowered to its desired position, it is ready for operation. The position of the instrument may be determined by a counter (not shown) to detect turns of the sheave 40, or the wire may be marked to indicate distance.

The combustion in the retort is controlled by the injection of oxygen bearing gases into the retort zone. The cased holes, including those extending down through the rubble, may be employed to recycle hot gases through the retort, for sampling the gases during retorting, and for providing ducts for the introduction of the monitoring instruments into the retort at selected depths. The instruments will provide the operator with continuous data in regard to temperatures in the various zones of the retort, snuffed out combustion fronts, uneven advances in the combustion front and other changes in the retorting operation. These various changes may be controlled by increase or decrease of the air injection rate through the air introduction holes and in the event of a snuffed out combustion front, the shale may be reignited through selected cased holes by the introduction of the required igniting apparatus to the zone affected. With the detection and control facilities thus provided the system lends itself to process control by fully automated operation.

The cased holes serve a further purpose after the completion of the retorting operation. After the completion of the retorting operation, some shale oil or "keronol" remains, forming pools in irregularities in the floor of the retort and on the surfaces of the fragmented pieces; liquid may be recovered by secondary recovery methods including the introduction of water through selected cased holes and the use of various surfactants as may be required under particular circumstances.

During the retorting operation, the shale oil flows downwardly through the fragmented shale and reaches the sumps 20 from which it is directed to the collection and pumping area 16. The construction and arrangement of the sumps is illustrated in FIGS. 5, 6 and 7. Each of the sumps which may, for example, be from fifteen to twenty feet in diameter, includes a strong walled bowl 46 which may be of steel and may be lined with one or more layers of fire brick, indicated at **46*a*. The sump bowl has a laterally extending annular flange 47 which is set into a shoulder in the upper end of respective raise 18 in the floor of the retort. The open top of the sump is provided with a grid comprising a multiplicity of I-beams 48 which are arranged in spaced parallel relationship on top of the bowl. The spaces between the I-beams which may be a few inches are provided in order to limit the size of fragments of shale which may pass downwardly into the bowl. The outlet of the bowl is the top end of the pipe 21 which is secured within the bowl on a supporting flange 48 welded to it and has a grid comprising a plurality of round bars 49 spaced apart and arranged in parallel across the top of the opening of the pipe 21 and secured to the pipe by welding or in any other suitable manner. The bars 49 provide a grid which limits the size of fragments which may move from the sump bowl into the pipe 21. The open end of the pipe 21 extends some distance above the bottom of the bowl, which leaves an annular area in which fragments unable to go through the grid 49 may collect. The pipe 21 extends downwardly through and is supported by props 50 within the raise 18 and extending from a flange 51 to the wall of the raise. The pipe is connected through an elbow and a horizontal pipe 52 to deliver the "keronol" or shale oil to the separator 22**.

As shown in FIG. 8, the collection and pumping level or zone 16 is illustrated, by way of example, as comprising four rooms 52 within the entry level and in each of which a separator 22 is installed. The separators 22 are connected to receive fluids from the sumps 20 through valved inlets 53 and to deliver the shale oil to pumps 23 arranged in rooms 54 through valved outlets 55 and pipes 57. The collection and pumping zone 16 as illustrated is accessible from the surface through a shaft 56 at its center and also is accessible through the extended horizontal passages 17 and 19 from similar collection and pumping zones below contiguous retorts on either side of the retort of FIG. 8. The rooms 52 and 54 and the shaft 56 and passages 17 and 19 are deep in the formation which surrounds them completely and provides heavy protecting walls on all sides. The position of the piller through which the shaft extends in the retort is indicated by dotted lines about the shaft. The pipe lines between the collectors 22 and the pumps 23 pass through passages 17 connecting the rooms 52 and 54; the delivery pipes for the pumps, indicated at 60, pass through the passage 19 to the shaft 56. As stated heretofore, the collection and pumping zone 16 is separated by a thick horizontal or roof pillar from the isolated retort, and personnel within the pumping and collection zone are thereby protected during the retorting operation. Suitable bulkhead doors may be provided in selected positions in the passages 17 and 19 to isolate the pumping and collection zone 16 from the corresponding zones of other retorts in case of emergency or other need.

All of the delivery pipes pass upwardly through the shaft and conduct the shale oil or "keronol" to the surface. Gas collected in the separator is also removed, gas outlets being provided at 61 at the top of each of the separator units and the gas being conducted to the surface through suitable pipes (not shown). Outlets for the sludge collected in the separator are also provided and the sludge is removed periodically as required and hoisted to the surface for treatment. The structural features of the separator are shown in FIGS. 9 through 12, FIG. 9 being an isometric view of the tank without its supply and discharge fittings. FIGS. 8 through 12 illustrate the tank with the fittings attached.

The separator tank 22 is relatively large and may, for example, have a volume sufficient to hold 2,000 barrels of oil. A capacity such as this affords time for solid particles to settle out while also serving as surge storage during repairs to the pumps or other equipment. The structure is simple, comprising flat sheets which may easily be carried in sections down the shaft and into the excavated separator room and assembled there by straight line welding.

The separator tank 22 comprises flat elongated rectangular top and bottom walls 62 and 63, respectively, the bottom wall sloping toward the outlet end. The inlet end plate, indicated at 64, is of elongated rectangular configuration and the outlet end plate, indicated at 65, is square. The side walls 66 and 67 are of truncated right-triangular configuration. The adjoining edges of the plates are welded together to provide a leakproof structure. As shown in FIGS. 10, 11, and 12, the tank is provided with fittings for admission of fluids and the discharge of sludge, liquids and gas therefrom. Fluids flowing from the sump drainpipe 21 are directed into the tank through the inlet connection 53 provided with a control valve 68 and a handle 69, the inlet fitting being mounted on the tank in open communication with an inlet opening 70 shown in FIG. 9. Within the tank there are mounted two vertical baffles 71 and 72 having their upper portions curved downstream as indicated at 73 and 74, respectively. Baffle 71 extends upwardly from the bottom wall or floor 63 and the curved portion 73 is spaced from the top wall 62 to afford passage of the fluids. The bottom edge of the baffle 72 is spaced from the bottom wall 63 of the tank allowing fluid to pass thereunder. Valved sludge discharge fittings 75 are mounted in holes 76 in the side walls 66 and 67 which open into the tank near the bottom adjacent the upstream side of the baffle 71. Fluids entering the tank flow into the portion of the tank above the baffle 71 and then flow outwardly over the curved top 73 of the baffle. The curved top induces non-turbulent streamline flow of the fluid current, while trapping settling rock particles which accumulate on the bottom as sludge and move toward the sludge outlets 75. The fluids thus flow over the baffle 71 and into the tank beyond the baffle and into the right-hand end of the tank. Fluids will also flow non-turbulently over the curved top 75 of the baffle 72, thus allowing solids in this second portion of the tank to pass downwardly along the sloping bottom wall 63 and collect adjacent the bottom of the end 65 which is provided with two sludge discharge valved fittings 77 mounted in holes 78 in the wall 65. The valves 75 and 77 are operated periodically to tap the tank and remove the sludge which is then collected in suitable containers for haulage to the surface. Gases enter the tank through the connection 53 with the liquid and collect about the liquid along the top of the separator and enter the gas outlet 61 including a dome 79 which is provided with a valved discharge fitting 80. The dome is mounted on the top wall 62 over an opening 81. Gases trapped in the dome flow out through the valve 80 and are conducted through a pipe 82 to a compressor (not shown) which may be located in a pumping room 54.

The liquid, which is a mixture of shale oil (keronol) and water created during the retorting process is removed from the separator through the valved outlet 55 connected in communication with the tank interior through an opening 83 in the wall 65. The liquid is pumped to the pumping room 54 and delivered to the surface by operation of the pump therein. The shale oil has a relatively high pour point and the water helps in pumping the shale oil through the pipes and up to the surface. When the liquid reaches the surface it is delivered to storage tanks (not shown) where it separates from the keronol by gravity. Water is tapped from the bottom of the storage tank and may be stored in a pit for its further use. Some of the water in the collector tank 22, which has settled toward the bottom, mixes with the solid material to form the sludge which is discharged through the outlets 75 and 77.

The separator 22 thus serves to separate all three constituents of the fluid material flowing from the retort, and particularly delivers keronol and water substantially free of particulate matter to the pump, whereby it is pumped to the surface for storage or transportation. By minimizing the particulate matter which may reach the outlet 55, the wear on the pumps is minimized and the equipment which is maintained underground therefore may be kept in operation a longer time without requiring servicing or repair. The curves at the top of the baffles help to maintain a streamlined flow of the fluid in the tank and thereby lessen turbulence and facilitate the separation of the solids from the liquids by providing more quiet areas for this purpose. The sloping bottom wall of the tank causes the collected solids to move downward toward the end 65 and the solid material is discharged from ports 75 and 77. The gas outlet 80, including the gas trapping dome 79, is provided so that gas may separate and be directed to the compressor for its removal to the surface, where together with other retort gases exhausted through cased holes in the formation, it may be used for various purposes including the generation of electricity.

The method of this system may be employed to develop large numbers of contiguous retort systems in a large tract of oil shale land and each retort system may be isolated by closing bulkhead doors between its working areas and those of adjacent retorts. The drilling and control zone and the separation and pumping zone are both isolated from the retorts by substantial thickness of rock in situ and these areas provide substantially safe working environment for the personnel. With sufficient thickness of the protecting pillars or walls of material, the working areas are separated from the retort during the preparation and firing thereof, and danger of injury to persons working in these areas is greatly reduced. For purposes of illustration, a schematic layout for the division of a tract of land to provide a multiplicity of retorts is shown in FIG. 13. In this figure the horizontal pillars or walls 29 dividing the tract into individual retorting zones have been indicated in section with shading, the shale within the retort area being shown without shading, and the crossing passages 24 and 26 providing communication between all of the retorts being indicated by continuous solid lines above the section plane. In this arrangement a rectangular area providing forty-two retorts is provided and nine shaft columns 83 have been provided for the shafts 56 providing access between the drilling and control zone and the collecting and pumping zone or level. Bulkhead doors (not shown) may be provided in the passageways in each of the dividing pillars. With such doors it is possible to isolate the collection and pumping levels of any retort from those of the other retorts. The same arrangement of isolating passageways and bulkhead doors is provided for the control and pumping level, the arrangement of the passageways being essentially the same. The cross passages 17 and 19 of the collection and pumping level are in vertical alignment with the passages 24 and 26 and provide access between the collection and pumping facilities below the retorting zones.

The oil shale which has been mined or extracted from the retort to create the voids needed to accommodate the rubbleized shale and which constitutes some 15 to 20 percent of the total oil shale originally contained in the retort zone, is brought to the surface and retorted above ground. Thus a considerable quantity of spent shale is created above ground together with the problem of its disposal. The present invention provides at least a partial solution to this problem as it contemplates the crushing and grinding of the shale and the forming of a slurry with the water that was pumped up with the keronol and the pumping of the slurry back down into the retort after retorting has been completed, the slurry being pumped through selected ones of the cased holes into the body of spent fragmented shale in the retort. The slurry serves to fill the voids in the retort and greatly reduce the likelihood of eventual surface subsidence over the retort.

During the retorting operation, the fragmented shale is raised to a high temperature and it retains a great quantity of heat stored in the enormous tonnage of fragmented rocks within the retort. Much of this energy can be recovered by processes utilizing selected ones of the cases holes prepared in the initial stages of the retorting operation. Several different procedures are available for extracting heat from the fragmented rock. For example, low BTU gases produced from the retorting of the shale excavated from the voids in the retort and which is performed at the surface may be delivered into the exhausted hot retort whereby the gases are heated and then may be piped to selected cased holes and delivered to the next retort to heat the fragmented shale therein. Thus, these heated gases may be used either for preheating or actual retorting even though additional heating of the gases might be necessary in some cases in order to attain full retorting temperature. By using the heat in the fragmented rock of the exhausted retort for preheating of another retort a substantial saving of energy may be realized. Another use of the heat of the exhausted retort could be accomplished by injecting water through selected cased holes into the exhausted retort to produce flash super-heated steam which could be delivered to turbines for driving generators and producing electricity. In another application for recovering heat from the exhausted retort, gases can be circulated through selected cased holes from the exhaust retort to an adjacent retort until the temperatures are approximately equal. The temperature under such conditions can be expected to be in a range of several hundred degrees Celsius. Upon stopping the circulation of the gases between the two retorts, water may be injected for the generation of steam as suggested above and to continue until the economics of the operation require its cessation. As long as there is a sufficient differential of temperature between adjacent retorts, one of the retorts upon completion of its retorting may be used to provide a quantity of stored heat energy for simple preheating of the adjacent retort or for initiating the retorting operation. Thus the heat energy in newly depleted retort 2 can be used effectively for the continued operation of a multiplicity of retorts and will result in the saving of very substantial quantities of heat energy.

Furthermore, the circulation of the hot gases or the injection of water for the production of steam may have some flushing effect within the exhausted retort, loosening shale oil or keronol adhering to the fragmented shale. Thus a more efficient recovery of the retorted product should be realized.

While this invention has been described in connection with one configuration of the operating zones and one type of retort excavating and fragmentation practice, various other applications and arrangements will occur to those skilled in the art and it is not desired that this invention be limited to the particular embodiment shown and described, and it is intended by the appended claims to cover all modifications within the spirit and scope of the invention.

I claim:

1. The method for preparing an underground oil shale deposit for in situ retorting of fragmented shale which comprises:

excavating shale from the deposit to form at least one void within the deposit having an aggregate volume sufficient to form a retort to contain and be substantially filled with the shale adjacent such void after its fragmentation, excavating a drilling and process control level underground above the retort and separated from the roof of the retort by a substantial depth of overburden, constituting a horizontal pillar to protect personnel and equipment during fragmentation and retorting of the shale, drilling holes from said level through the overburden into the deposit adjacent said void, placing explosive charges in said holes within the deposit, casing and valving selected ones of said holes within the horizontal pillar and plugging the remaining holes therein, setting off said charges for fragmenting the shale adjacent such void and filling the retort with fragmented shale, extending selected ones of said cased holes into the fragmented shale to selected depths, heating the shale in the retort to a temperature sufficient to release shale oil therefrom, utilizing said ones of said cased holes for facilitating the monitoring and control of the retorting of the fragmented shale in the retort, retorting above ground shale removed from the voids during excavation thereof, grinding the spent retorted shale, forming a water slurry with the ground retorted shale and pumping the slurry through said extended selected ones of said cased holes into the body of spent fragmented shale at the selected depths in the retort to fill the voids therein and thereby reduce the likelihood of eventual surface subsidence over the retort.

2. The method of claim 1 including the step of utilizing water recovered from the in situ retorting of the shale in the preparation of said slurry.

3. The method for preparing an underground oil shale deposit for in situ retorting of fragmented shale which comprises:

excavating a working and fluid product collecting zone a substantial distance below the deposit to be retorted and one or more raises therefrom to the deposit for access to the deposit, and for providing a horizontal pillar of sufficient thickness to form a protecting roof for preventing injury to personnel and equipment in said zone during fragmentation and retorting of the shale, excavating shale from the deposit to form at least one void within the deposit having an aggregate volume sufficient to form a retort to contain and be substantially filled with the adjacent shale after its fragmentation, providing a protecting closure for the upper end of each of said raises and piping for affording a flow of fluids downwardly past the closure and through the respective raise to collecting equipment in said zone, preparing a drilling and process control level above the retort and separated from the roof of the retort by a substantial depth of overburden to provide a horizontal pillar of sufficient depth to protect personnel and equipment during fragmentation and retorting of the shale, drilling holes from said level through the overburden and into the deposit adjacent such void to form a pattern of holes within the deposit for receiving explosive charges, placing explosive charges in said holes within the deposit, casing and valving selected ones of said holes within the overburden and plugging the remaining holes therein, setting off said charges for fragmenting the shale between said voids and filling the retort with fragmented shale, heating the fragmented shale in the retort to temperatures sufficient to release shale oil therefrom, utilizing selected ones of said cased holes for facilitating the monitoring and control of the retorting of the fragmented shale in the retort, and removing the fluid product from the bottom of the retort and delivering it through said piping downwardly to said collecting zone.

4. The method of claim 3 wherein such void is slot-like and has substantially parallel faces and wherein said holes are drilled along lines substantially parallel to the faces of said void and said drilling and process control level is underground and includes galleries each extending along the drilling positions for a respective one of said lines of said holes.

5. The method of claim 3 wherein a plurality of said selected ones of said holes are used for injecting oxygen bearing gases into said retort to maintain combustion therein.

6. The method of claim 3 wherein a plurality of said cased holes are utilized for holding temperature sensing devices in position for monitoring the temperatures of selected zones of the retort.

7. The method of claim 3 wherein a plurality of said cased holes are provided with means for igniting the shale in the retort.

8. The method of claim 3 wherein at least one of said cased holes is utilized for injecting inert gases to be heated by spent fragmented shale after the retorting operation and for delivering the heated gases to a second retort for preheating the fragmented shale therein, whereby heat energy in the exhausted retort is conserved and utilized.

9. The method of claim 3 wherein at least one of said cased holes is utilized for injecting water onto the hot spent shale in the retort to generate steam in said retort and at least one other of said cased holes is utilized for delivering the steam for use outside the retort.

10. The method of claim 3 wherein said drilling control level is below the surface of the ground and comprises drilling galleries in vertical alignment with the holes to be drilled into the deposit, said level being spaced above the retort a distance sufficient to provide a thick horizontal pillar for the protection of personnel at said level during the retorting operation, said holes being drilled through said pillar to the deposit.

11. The method of claim 10 including the steps of preparing and completing a multiplicity of like retorts including respective drilling and control levels in the shale deposit and separated from one another by continuous wall pillars and having their respective drilling and control levels in substantial horizontal alignment with one another.

12. The method of claim 11 including the step of providing passages between adjacent ones of said drilling and control levels and bulkhead doors in certain of said passages for isolating the level of each retort in the event of emergency whereby the drilling and control levels of one retort may be isolated from those of other retorts.

13. The method of claim 3 including the step of providing a shaft connecting said collecting zone and said drilling and process control level, said shaft passing through a supporting pillar extending between the floor and roof of said deposit and providing access between said level and zone.

14. The method of claim 3 wherein each of said closures comprises a sump provided in the floor of the deposit at low points therein and the piping extends from each sump in closed communication with fluid collecting equipment in the product collecting zone and fluids from the retort are thereby directed downwardly through the sumps to the equipment in the collecting zone.

15. The method of claim 14 including the step of providing over each of the sumps a grating for limiting the size of fragments of the deposit which may pass to the collecting zone.

16. The method of claim 15 wherein the grating constitutes a heavy reinforcing member for protecting the sump during the fragmenting of the shale and for limiting the size of fragments which may enter the sump.

17. The method of claim 16 including the providing of a second grating positioned at the outlet of the sump for limiting the size of fragments which may pass to said collecting zone.

18. The method of claim 3 including the steps of preparing and completing a multiplicity of like retorts in the shale deposit separated from one another by continuous wall pillars and having their respective collecting zones in substantial horizontal alignment and in communication with one another, and providing bulkhead doors for closing the communication between said zones.

19. The method of claim 3 wherein said drilling and process control level is underground and including the step of providing passages between adjacent respective ones of said levels and zones of said retorts, and bulkhead doors in certain of said passages for isolating the respective level or zone of each retort in the event of emergency whereby the drilling and control levels of one retort may be isolated from those of the other retorts and in a similar manner the collecting zone of each retort may be isolated from the collecting zones of the other retorts.

20. The method for preparing an underground oil shale deposit for in situ retorting of fragmented shale which comprises:

excavating a working zone in the formation below the floor of the planned retort and spaced downwardly a substantial distance therefrom to provide a horizontal pillar of sufficient thickness to protect personnel and equipment in said working zone during the fragmentation and retorting of the shale, excavating at least one raise from said zone upwardly into the planned retort, excavating shale from the planned retort to form at least one void therein having an aggregate volume sufficient to form a retort to contain and be substantially filled with the shale adjacent such void after its fragmentation, utilizing the raise for removing shale excavated from such void, providing a protecting closure for the upper end of each of said raises and piping means for affording a flow of fluids downwardly past the closure and through the respective raise to said zone, drilling holes into the deposit adjacent such void to form a pattern of holes in the deposit for receiving explosive charges, placing explosive charges in said holes, setting off said charges for fragmenting the shale adjacent such void and filling the retort with fragmented shale, providing access to the upper portion of the retort for igniting the fragmented shale and supplying combustion supporting gas thereto, providing a closed fluid collecting means in said zone, and utilizing said piping means for directing the liquid product of the retorting of the shale downwardly through the respective raise and into said collecting means.

21. The invention of claim 20 including the steps of providing at least one separator in said zone for removing sludge from the liquid and providing at least one pump in said zone for discharging the collected liquid from said zone.

22. The method of claim 20 including wherein said closure is a sump in the upper portion of said raise, said sump being sealed to the floor of the deposit adjacent the raise, and providing a structural grid across the top of said sump for protecting the sump from damage during the fragmenting of the shale and for limiting the size of the fragments which may pass to the sump.

23. The invention of claim 22 wherein said piping comprises an outlet drainpipe leading from said sump downwardly through the raise and having its upper end extending above the bottom of the sump, and providing a grid across the opening of the pipe for limiting the size of solid matter which may be discharged from the sump.

24. The method for preparing an underground oil shale deposit for in situ retorting of fragmented shale which comprises:

excavating shale from the deposit to form at least one void within the deposit having an aggregate volume sufficient to form a retort to contain and be substantially filled with the shale adjacent such void after its fragmentation, excavating a drilling and process control level above the retort and separated from the roof of the retort by a substantial depth of overburden sufficient to protect personnel and equipment during fragmentation and retorting of the shale, drilling holes from said level through the overburden into the deposit adjacent said voids, placing explosive charges in said holes within the deposit, casing and valving selected ones of said holes in the overburden and plugging the remaining holes therein, setting off the charges for fragmenting the shale adjacent the void and filling the retort with fragmented shale, extending selected ones of said cased holes into the fragmented shale to selected depths therein, heating the fragmented shale in the retort to a temperature sufficient to release kerogen therefrom, utilizing selected ones of said cased holes for facilitating the monitoring and control of the retorting of the fragmented shale in the retort, and for directing the flow of fluids to or from the retort, and removing the fluid product from the bottom of the retort.

25. The method for preparing an underground oil shale deposit for in situ retorting of fragmented shale which comprises:

excavating a working and fluid product collecting zone a substantial distance below the deposit to be retorted and one or more raises therefrom to the deposit and for providing a horizontal pillar of sufficient thickness to form a protecting roof for preventing injury to personnel and equipment in said zone during fragmentation and retorting of the shale, excavating shale from the deposit to form at least one void within the deposit having an aggregate volume sufficient to form a retort to contain and be substantially filled with the adjacent shale after its fragmentation, providing a protecting and liquid collecting closure for the upper end of each of said raises and piping means for affording a flow of fluids downwardly past the closure and through the respective raise to collecting equipment in said zone, explosively fragmenting the shale between said voids and filling the retort with fragmented shale, heating the fragmented shale in the retort to temperatures sufficient to release shale oil therefrom, and removing the fluid product from the bottom of the retort and delivering it through said piping to the collecting equipment in said zone.

* * * * *